US006723982B1

(12) United States Patent
Shackleford et al.

(10) Patent No.: US 6,723,982 B1
(45) Date of Patent: Apr. 20, 2004

(54) STORAGE REDUCTION METHOD AND APPARATUS FOR MASS SPECTROSCOPY ANALYSIS

(75) Inventors: J. Barry Shackleford, Portola Valley, CA (US); Motoo Tanaka, Tokyo (JP)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/618,189

(22) Filed: Jul. 10, 2003

(51) Int. Cl.[7] ..... H01J 49/26

(52) U.S. Cl. ..... 250/281; 250/282; 250/288; 435/7.1

(58) Field of Search ..... 250/281, 282, 250/288; 435/7.1

*Primary Examiner*—Nikita Wells

(57) ABSTRACT

A method and apparatus reduces storage requirements for identifying a sequence of elements in a compound. The storage reduction receives a set of monoisotopic masses designed to address entries from two or more mass spectroscopy data sets according to a fitness function, analyzes the fitness function configured to facilitate identification of a sequence of elements in the compound, determines a minimum address range for addressing entries in each of the two or more mass spectroscopy data sets according to sequence of elements and fitness function analysis and reduces the size of at least one of the two or more mass spectroscopy data sets to selected mass data values according to the minimum address range.

32 Claims, 7 Drawing Sheets

STORAGE REDUCTION METHOD AND APPARATUS FOR MASS SPECTROSCOPY ANALYSIS

BACKGROUND OF THE INVENTION

The present invention relates to a method and apparatus for improving data analysis of molecules processed using mass spectroscopy.

Recent advances have made mass spectroscopy available in the analysis of biologic molecules. Most notably, new methods of heating biological substances indirectly have allowed them to be analyzed using mass spectroscopy without being destroyed. Using these indirect heating methods, biological substances are vaporized and then bombarded with electrons to charge the resulting mixture and create an ionized gas. The ions pass through one end of a mass spectrometer where a combination of electric and magnetic fields accelerate them towards various detectors.

Ions travel at different speeds through the mass spectrometer depending on their mass and charge thus measuring how long they travel provides a relative indication of their weight. Heavier particles travel more sluggishly for shorter distances than lighter particles under the influence of these fields in the mass spectrometer. The detector within the mass spectrometer produces a relative mass-to-charge ratio (m/z) value along with a relative measure of intensity.

Computer assisted biological analysis uses the mass spectral data produced through mass spectroscopy to classify the biological makeup of a sample. Classification involves searching through a library or table of isotopic masses and identifying the constituent elements. An isotopic or monoisotopic mass is calculated using the mass of the most abundant natural isotope of each constituent element. In comparison, an average mass is calculated using the "atomic weight" of each constituent element, which is the weighted average of all its natural isotopes.

Commercial application of these classification techniques can be applied, for example, in the analysis of proteins, peptides, carbohydrates, oligonucleotides, natural products and drug metabolites. Results from the classification not only helps characterize the elements of a compound but may also give insights to the structural relationship between the various large or small molecules. Because the physical and chemical properties and biological activities of chemical compounds are to a large extent a function of molecular structure, the results of classification analysis also reflects structural features that are determined by fragmentation ions appearing in a mass spectrum. One important advantage of computer assisted biological analysis and classification is the fact that a user is not required to have detailed knowledge of the complex spectra-structure relationship to get useful results.

Consequently, the demand for mass spectroscopy is increasing as its application of analyzing various biological substances grows. For example, mass spectroscopy is an important analytical tool for research in protein engineering and other areas of proteonomics as it is highly accurate and works well with small samples. Unfortunately, many computer assisted biological techniques remain inefficient and primitive. In particular, the computational systems used in conjunction with mass spectroscopy need further improvement and refinement as well as reduced costs. Successful efforts in these areas will further accelerate advances in research and popularize use of this important analytical tool by biological and scientific researchers.

BRIEF DESCRIPTION OF THE DRAWINGS

Like reference numbers and designations in the various drawings indicate like elements.

SUMMARY OF THE INVENTION

One aspect of the present invention describes a method of reducing storage requirements for identifying a sequence of elements in a compound. The storage reduction includes receiving a set of monoisotopic masses designed to address entries from two or more mass spectroscopy data sets according to a fitness function, analyzing the fitness function configured to facilitate identification of a sequence of elements in the compound, determining a minimum address range for addressing entries in each of the two or more mass spectroscopy data sets according to a sequence of elements and fitness function analysis and reducing the size of at least one of the two or more mass spectroscopy data sets to selected mass data values according to the minimum address range.

Another aspect of the present invention-describes identifying a sequence of elements in a compound with reduced storage requirements. The identification includes receiving a set of monoisotopic mass lookup tables for accessing two or more mass spectroscopy data sets in parallel according to a fitness function, identifying a first portion of addresses determined directly from offset values corresponding to a monoisotopic mass lookup table from the set of monoisotopic mass lookup tables, accessing a selected number of mass spectroscopy data set values for the compound using additional logic and the offset values directly and evaluating the fitness function to determine elements in the compound based upon mass spectroscopy data set values accessed directly from the offset values corresponding to the monoisotopic mass lookup table.

DETAILED DESCRIPTION

Aspects of the present invention are advantageous in at least one or more of the following ways. Implementations of the present invention analyze a fitness function to more accurately allocate storage or memory for evaluating mass spectroscopy data. By considering the fitness function constraints, a number of elements in one or more mass spectroscopy data sets can be eliminated from consideration during analysis. This can result in lower production costs and smaller die requirements as the mass spectroscopic data storage needs are reduced.

Figure 1A:
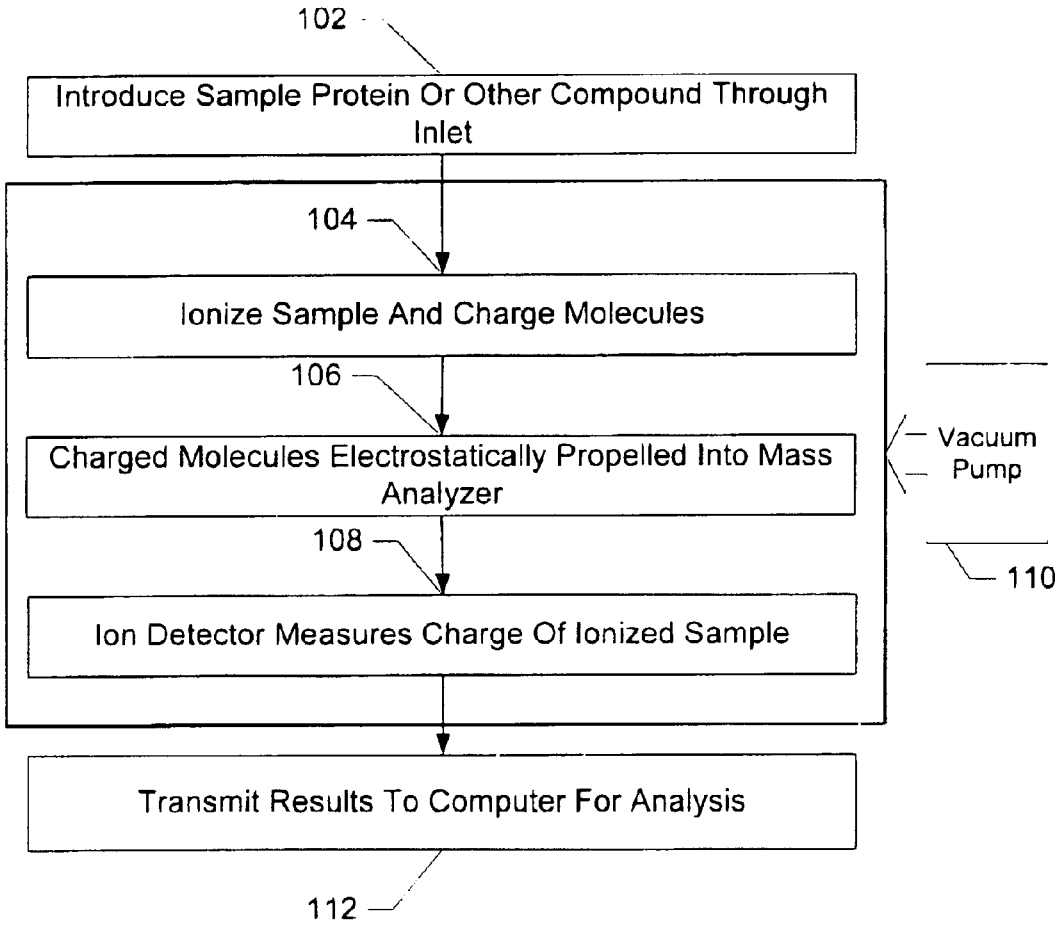
FIG. 1A depicts a flowchart diagram of the operations for analyzing a sample using a mass spectrometer.

FIG. 1A depicts a flowchart diagram of the operations for analyzing a sample using a mass spectrometer. Initially, a sample is introduced through an inlet of the mass spectrometer (102). Sensitive and properly calibrated mass spectrometers can operate on extremely small samples of biological materials and perform highly accurate analysis. Scientist now regularly rely on mass spectroscopy to identify active genes in cells and proteins which genetic methods cannot readily process.

An ion source ionizes the sample introduced and charges the molecules (104). With biological samples like proteins and genetic material, two ion-producing methods are typically used: electrospray ionization (ESI) and the matrix-assisted laser desorption ionization (MALDI). Both these methods are able to heat the samples into a gaseous state and charge them without destruction. In addition to ionization, chemicals or enzymes may also be introduced to further break the protein samples into peptide fragments.

While under vacuum by vacuum pump 110, the charged molecules are electrostatically propelled into mass analyzer (106) and ion detector that measures the charge of the ionized sample (108). The time of flight it takes a molecule to travel from the point of ionization to the detector is a function of the mass-to-charge (m/z) ratio of a particle. Large molecules with greater mass travel slower than smaller molecules while molecules with larger charge (e.g. 2+) tend to travel faster than molecules with a smaller charge (e.g. 1+). Results are transmitted to a computer for analysis (112) where the principles of chemistry, physics and other disciplines are used to analyze and identify the compound.

Figure 1B:
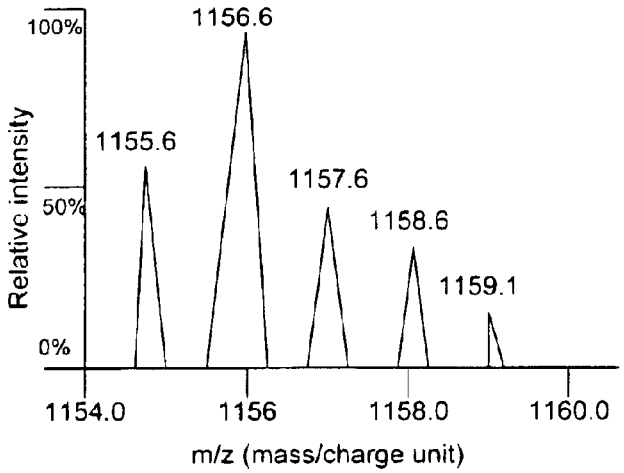
FIG. 1B is a hypothetical plot of monoisotopic peaks associated with ions produced from a sample processed through a mass spectroscopy device.

FIG. 1B is a hypothetical plot of the monoisotopic peaks associated with ions produced from a sample processed through a mass spectroscopy device. Each spike corresponds to different elements of a sample compound and the relative amounts each element occupies in the compound. Unknown compounds can be identified by narrowing the field of possible elements in the compound and then matching the mass-charge (m/z) measurements along with the relative intensity levels to determine both a sequence and quantity of elements in the compound. In the case of proteins, it is known that all proteins are created from a combination of 20 amino acids joined together by covalent bonds. These 20 amino acids are organized into polypeptides of varying length, different linear sequences, and three-dimensional configurations. While DNA sequences can be used to identify a protein, it is often more advantageous to classify and identify proteins directly. The mass spectrometer accurately measures the mass of a compound but careful analysis is still needed to interpret the results. Unfortunately, protein identification using conventional analysis remains time consuming and compute/resource intensive compared with implementations of the present invention.

Figure 2:
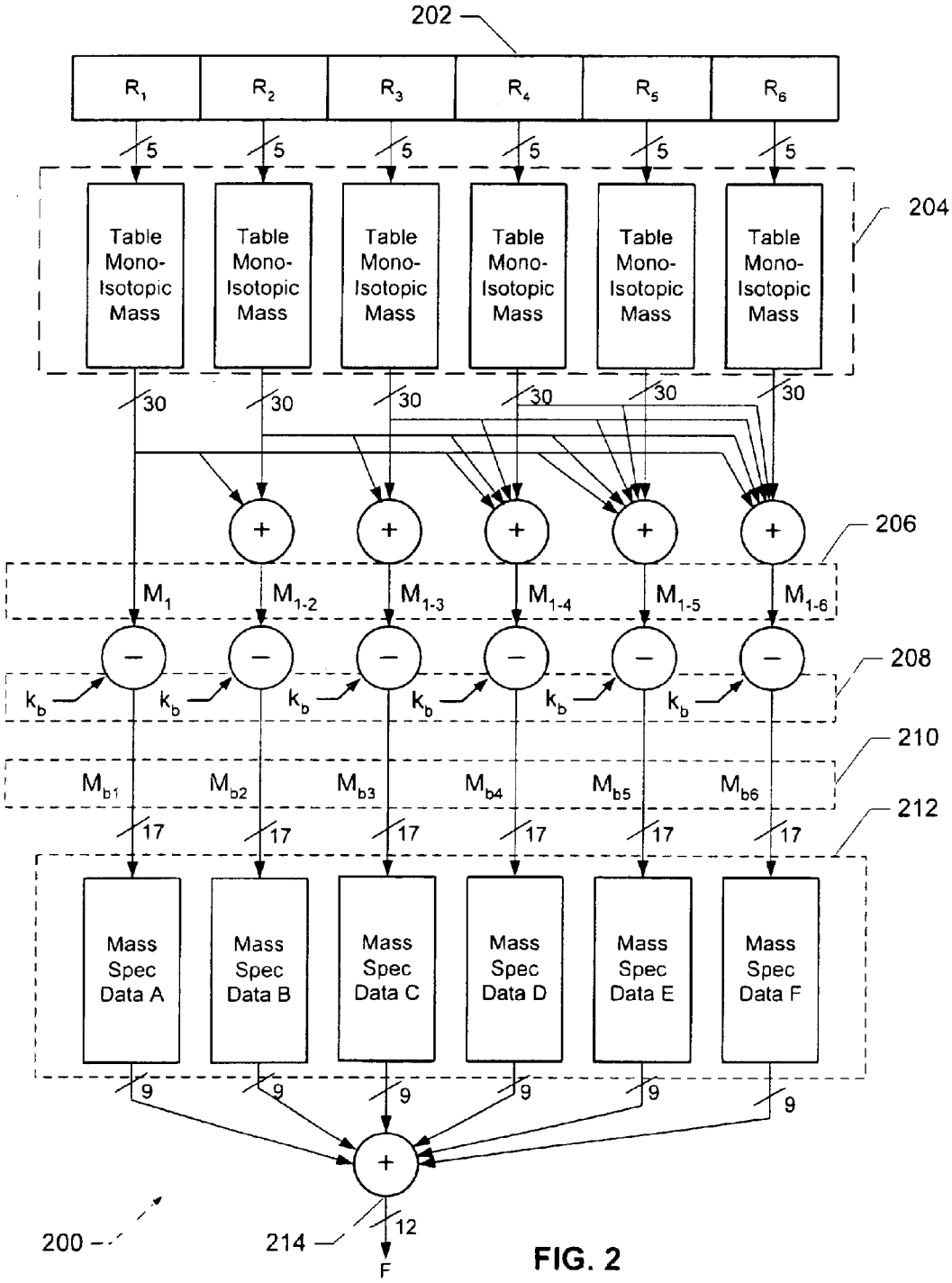
FIG. 2 is a block diagram illustration of a fitness function implemented in hardware and used to identify an amino acid sequence for a protein in accordance with implementations of the present invention.

FIG. 2 is a block diagram illustration of a fitness function 200 implemented in hardware and used to identify an amino acid sequence for a protein. In this example, fitness function 200 includes a chromosome register 202, monoisotopic mass look-up-tables (LUTs) 204, a set of reside masses 206, a set of constants ($k_b$) 208 for adjusting the residue mass value, a set of b-ion reside masses 210 and mass spectroscopy data 212 collected from the mass spectroscopy device for a sample protein. Alternative, fitness functions could also be created to study other types of biological research.

In operation, chromosome register 202 is loaded with a hypothetical set of six amino acids also identified as residue values. The amino acids loaded in the chromosome register 202 can be generated in accordance with Genetic Algorithm (GA) principles as further described in co-pending United States Patent Application entitled, "RANDOM NUMBER GENERATOR METHOD AND SYSTEM FOR GENETIC ALGORITHM ANALYSIS", Ser. No. 10/413,779 by J. Barry Shackleford and Motoo Tanaka assigned to the assignee of the present invention and incorporated by reference herein.

Initially, a GA logic generates a random sequence of amino acids and iteratively evaluates the amino acid according to a fitness function. Eventually, the GA logic converges upon an optimal solution or sequence of amino acids. An alternate solution to using GA, loads every possible combination and sequence amino acids into chromosome register 202 and selects the sequence that best fits according to the fitness function. This latter "brute force" approach may take more time to process as each possible sequence entered into chromosome register 202 must be determined and evaluated. In contrast, GA analysis may converge on the solution more rapidly but requires additional hardware as described in further detail later herein.

The 20 amino acids are represented by 19 different mass values as one pair of the amino acids is essentially the same mass. Accordingly, each of the six residues in chromosome register 202 store a 5-bit value identifying one of the 19 different mass values. The selected 5-bit identifier addresses a mass value from monoisotopic mass LUTs 204 and outputs a 30-bit number corresponding to the mass value. The mass value selected from monoisotopic mass LUTs 204 is processed according to logic within fitness function 200 as illustrated. In this example, fitness function 200 adds one or more of the six mass values selected from monoisotopic mass LUTs 204 together in different combinations to generate residue masses 206. The set of constants 208 (where $k_b$ ranges from 1.007825 to 198.963275) are subtracted from the set of residue masses 206 creating the set of b-ion residue mass 210 to be matched with mass spectroscopy data 212. If the hypothetical amino acid sequence loaded in chromosome register 202 matches the unknown protein then a large fitness function value 214 is produced indicating that the unknown protein has been identified.

By analyzing operation of fitness function 200 in FIG. 2, it is observed that no more than 5-bits are actually required to address mass spec data A, 10-bits to address mass spec data B and 15-bits to address mass spec data C. Because register $R_1$ of chromosome register 202 specifies one of 19 amino acids, $2^5$ or 32 addresses are more than enough for addressing the 19 different possible selections; this is far less than the $2^{17}$ or 131,072 different potential mass values collected by the mass spectrometer and stored in a table in mass spec data A from mass spectroscopy data 212.

Similarly, $2^{10}$ or 1024 addresses are more than enough to address the $19^2$ possible selections or 361 different locations required when fitness function 200 combines mass values corresponding to registers $R_1$ and $R_2$ in chromosome register 202. Again, a large portion of the $2^{17}$ or 131,072 different potential mass values collected by the mass spectrometer and stored in mass spec data B are not addressable by only the combination of registers $R_1$ and $R_2$. Finally, it is also observed that combining registers $R_1$, $R_2$ and $R_3$ according to fitness function 200 can address only $19^3$ or 6859 different locations from mass spec table C in mass spectroscopy data 212. Once again, $2^{15}$ or 32,768 addresses are more than enough to address the $19^3$ or 6859 potential entries to be retrieved from mass spec table C in mass spectroscopy data 212. Clearly, operating on parallel copies of the mass spectroscopy data has improved the analysis performance compared with operating on the mass spectroscopy data serially yet there remains large amounts of wasted or unnecessary storage.

Figure 3:
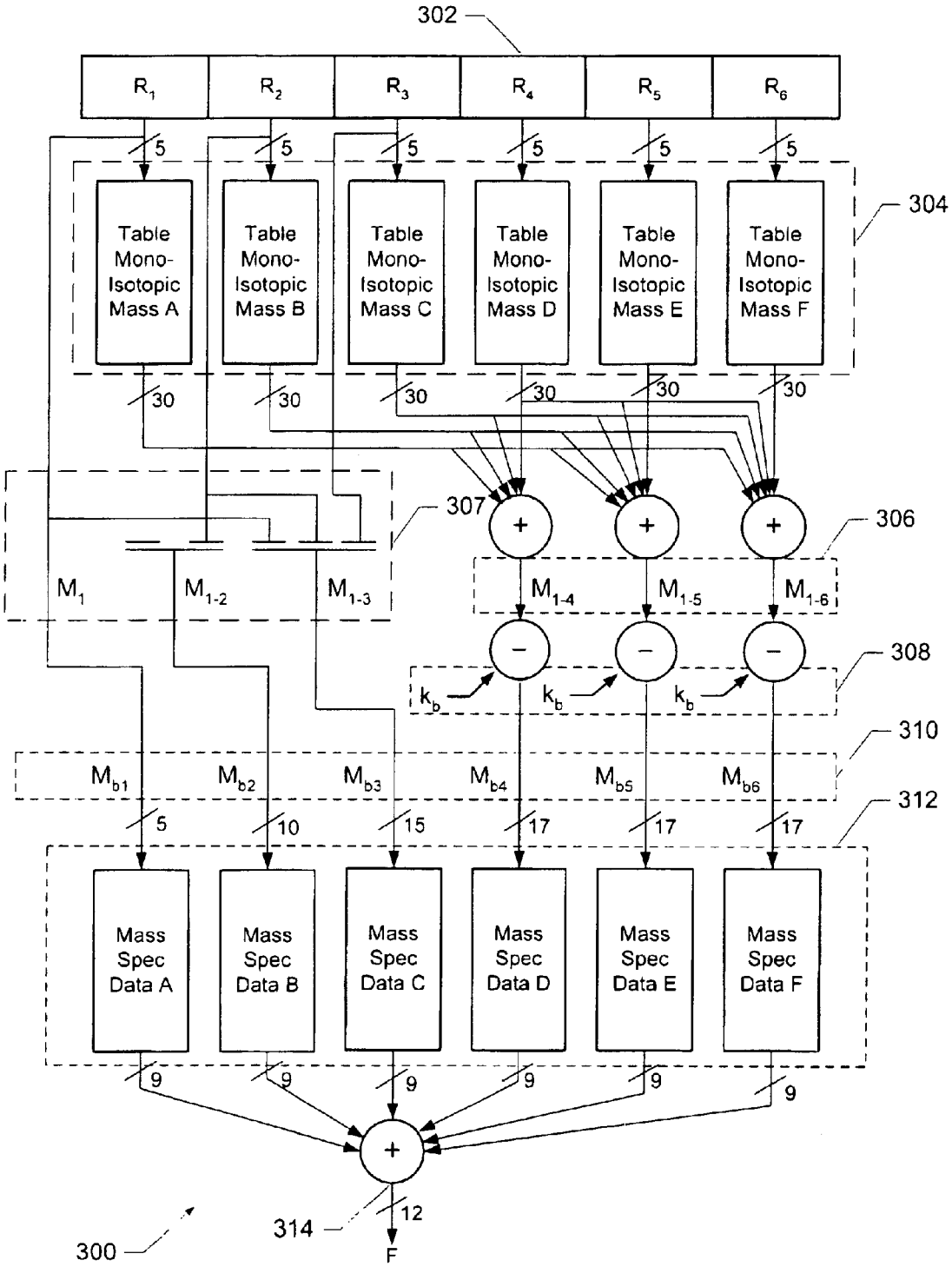
FIG. 3 is a block diagram illustrating a fitness function implemented in hardware in accordance with implementations of the present invention.

FIG. 3 is a block diagram illustrating a fitness function 300 implemented in hardware in accordance with implementations of the present invention. Fitness function 300 has been modified to utilize less storage or memory resources compared with fitness function 200 in FIG. 2. In this example, fitness function 300 includes a chromosome register 302, monoisotopic mass LUTs 304, a set of residue masses 306, concatenation logic 307, a set of constants 308 ($k_b$) for adjusting the residue mass value, a set of b-ion reside masses 310 and mass spectroscopy data 312 collected from the mass spectroscopy device.

Like elements of fitness function 300 operate similar to fitness function 200 except for the use of concatenation logic 307 and the reduced width of address lines going into and out of concatenation logic 307. Further, mass spec data A, mass spec data B and mass spec data C in mass spectroscopy data 312 are reduced in size in accordance with implementations of the present invention due to the smaller address requirements. For example, each individual mass spec data A through D in FIG. 3 use much less storage than the $2^{17}$ or approximately 131,072 data units used by each of the storage areas of mass spec data 212 in FIG. 2. In particular, mass spec data A uses only $2^5$ or 32 storage units to store 19 values, mass spec data B uses only $2^{10}$ or 1024 storage units to store $19^2$ or 361 values and mass spec data C uses no more than $2^{15}$ or 32,768 storage units to store $19^3$ or 6859 values. While some addresses remain unused, the savings in storage for fitness function 300 in FIG. 3 compared with fitness function 200 in FIG. 2 is approximately 46%.

Of course, while fitness function 300 is used to identify an unknown protein or class of proteins alternate implementations of the present invention may use different fitness functions depending on the details of the biological or scientific problem being solved. Accordingly, implementations of the present invention are not limited to the specific fitness function 300 described herein but may apply to other analogous fitness functions capable of benefiting from implementations of the present invention.

In operation, fitness function 300 evaluates residues in chromosome register 302 in parallel. Instead of using a mass value from monoisotopic mass A, a 5-bit address is read directly from register $R_1$ and provided to concatenation logic 307. In this case, the 5-bit wide address is passed directly to mass spec data A in mass spectroscopy data 312. Because monoisotopic mass LUTs 304 are bypassed, values in mass spec data A are rearranged to correspond to the 5-bit amino acid identifier values rather than an actual mass value.

Residues from $R_2$ are passed to concatenation logic 307 as a 5-bit value and combined directly with the 5-bit address from register $R_1$ to form a 10-bit value. Additional residues from $R_3$ are passed to concatenation logic 307 as a 5-bit value and combined directly with both of the 5-bit amino acid identifiers from register $R_1$ and register $R_2$ to form a 15-bit address. Values in mass spec data B. and mass spec data C are both rearranged to correspond to the 10-bit and 15-bit identifiers as the combined mass values derived from monoisotopic mass LUTs 304 are bypassed again. In accordance with implementations of the present invention, a significant reduction in memory storage requirements are obtained by using the smaller address range and only a nominal increase in logic cell area required for concatenation logic 307.

Figure 4:
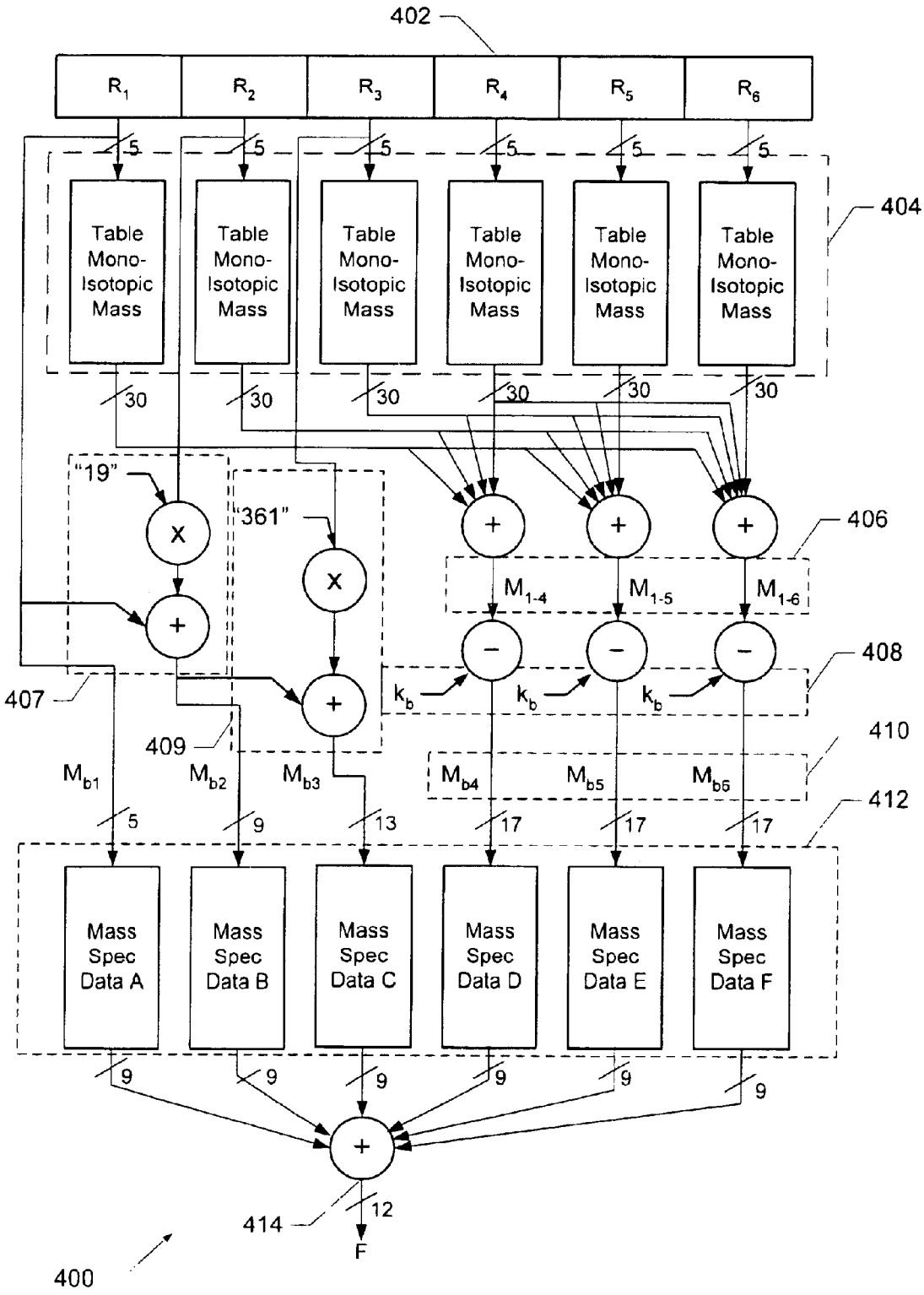
FIG. 4 is a block diagram illustration of hardware for reducing memory or storage requirements for a fitness function in accordance with another implementation of the present invention.

The block diagram in FIG. 4 illustrates hardware for reducing memory or storage requirements for a fitness function in accordance with another implementation of the present invention. Fitness function 400 in FIG. 4 has been modified even further in accordance with implementations of the present invention to utilize less storage or memory resources compared with fitness function 300 in FIG. 3. In this example, fitness function 400 includes a chromosome register 402, monoisotopic mass LUTs 404, a set of residue masses 406, constant address logic 407 and 409, a set of constants 408 ($k_b$) for adjusting the residue mass value, a set of b-ion reside masses 410 and mass spectroscopy data 412 collected from the mass spectroscopy device. If the hypothetical amino acid sequence loaded in chromosome register 402 matches the unknown protein then a large fitness function value 414 is produced indicating that the protein has been identified.

Elements of fitness function 400 operate similar to fitness function 200 and fitness function 300 in FIG. 2 and FIG. 3 respectively except for the use of constant address logic 407 and 409 and the further reduced width of address lines going into and out of constant address logic 407 and 409. Further, mass spec data A, mass spec data B and mass spec data C in mass spectroscopy data 412 are even further reduced in size due to the smaller address requirements. In this example, each individual mass spec data A through D in FIG. 4 use much less storage than the $2^{17}$ or approximately 131,072 data units used by each of the storage areas of mass spec data 212 in FIG. 2. In particular, mass spec data A uses only $2^5$ or 32 storage units to store 19 values, mass spec data B uses only $2^9$ or 512 storage units to store $19^2$ or 361 values and mass spec data C uses no more than $2^{13}$ or 8,192 storage units to store $19^3$ or 6859 values. While some addresses and storage area remains unused, the savings in storage for fitness function 400 compared with fitness function 200 in FIG. 2 is approximately 49%.

In operation, fitness function 400 also evaluates residues in chromosome register 402 in parallel. Instead of using a mass value from monoisotopic mass A, a 5-bit address is read from register $R_1$ and passed directly to mass spec data A in mass spectroscopy data 412. Again, values in mass spec data A are rearranged to correspond to the 5-bit amino acid identifier values rather than an actual mass since monoisotopic mass LUTs 304 are bypassed.

Residues from $R_2$ are passed to constant address logic 407 as a 5-bit value and multiplied by the constant "19" before being added to the 5-bit address from register $R_1$ and delivered as a 9-bit value to mass spec data B. Additional residues from $R_3$ are passed to constant address logic 409 as a 5-bit value and multiplied by the constant "361" before being added to the 9-bit address used to access values in mass spec data B. The resulting 13-bit address produced by constant address logic 409 is then used to access mass spec data C.

In accordance with implementations of the present invention, a significant reduction in memory storage requirements are obtained with nominal increases in logic cell area required for constant address logic 407 and 409. Values in mass spec data B and mass spec data C are both rearranged to correspond to the correct 9-bit and 13-bit identifiers as the combined mass values derived from monoisotopic mass LUTs 404 are also bypassed. In this example, the constants "19" (i.e., $19^1$) and "361" (i.e., $19^2$) were selected based on the 19 possible different amino acid masses however alternate constant values for constant address logic 407 and 409 could also be selected depending on the desired trade-offs in memory size and logic cell area. For more information on selecting alternate constant values for addressing, see United States Patent Application entitled, "EFFICIENT ADDRESSING METHOD AND APPARATUS FOR STORAGE" by J. Barry Shackleford and Motoo Tanaka, Ser. No. 10/423,773 assigned to the assignee of the present invention and herein incorporated by reference.

Figure 5:
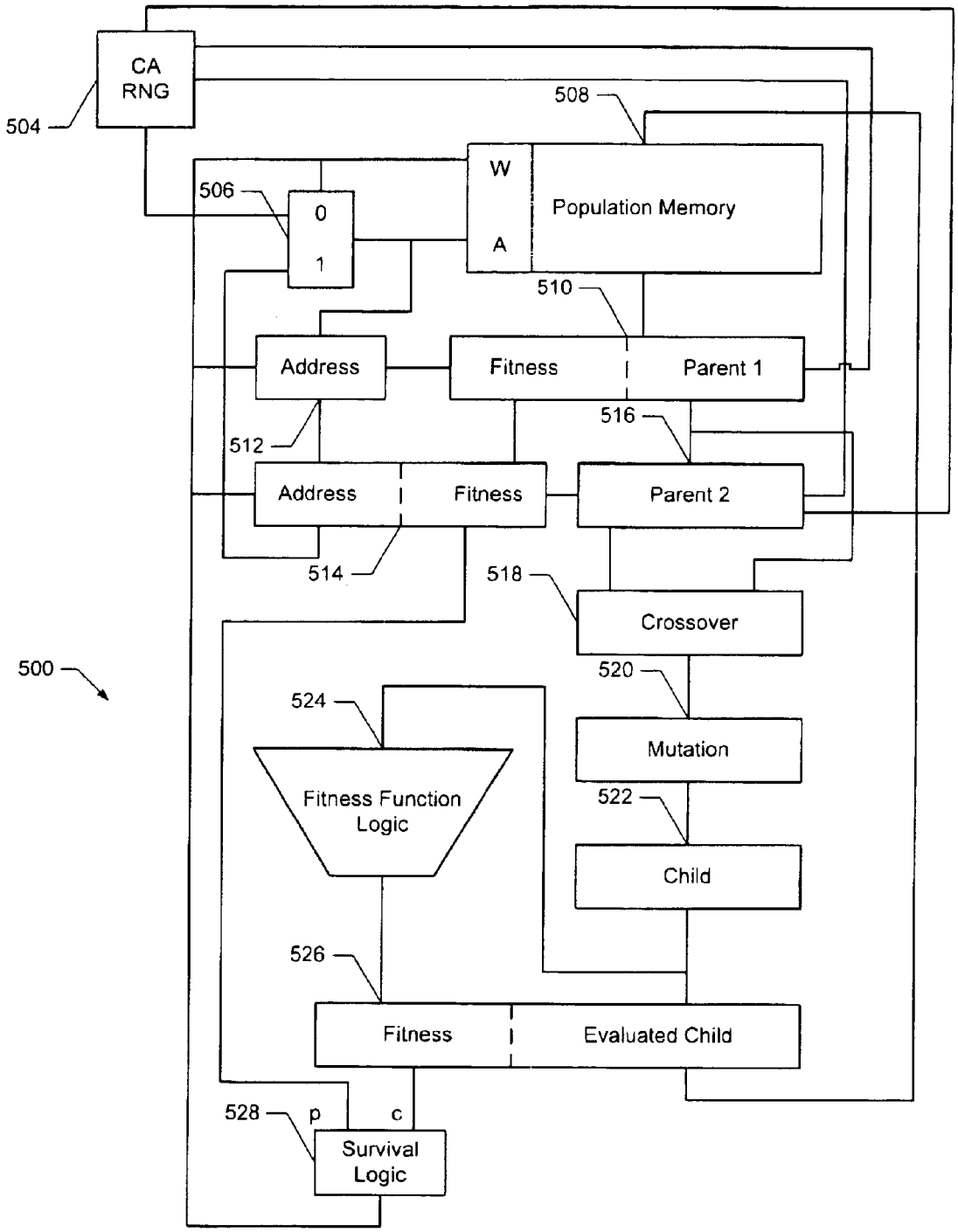
FIG. 5 is a block diagram depicting a fitness function in a genetic algorithm circuit capable of using implementations of the present invention to reduce memory or storage requirements.

Applications of the present invention can be used to reduce the memory or storage requirements in systems using a fitness function. As previously described, one implementation loads the chromosome register in a "brute force" manner by sequencing through every possible amino acid combination. Alternatively, genetic analysis (GA) circuits can be used to more efficiently to determine a solution to the fitness function by randomly inserting values in the chromosome register and iteratively identifying an optimal solution according to a fitness function. For example, the fitness function used by genetic algorithm (GA) circuit in FIG. 5 uses implementations of the present invention to reduce memory and storage. GA circuit 500 includes a cellular automata random number generator (CA RNG) 504, a population memory MUX 506, a population memory 508, a parent 1 and fitness register 510, a parent 1 address register 512, a parent 2 address and fitness register 514, a parent 2 register 516, crossover logic 518, mutation logic 520, a child register 522, fitness function logic 524, evaluated child and fitness register 526, and survival logic 528.

During initialization mode, CA RNG 504 produces random numbers used for a variety of purposes in the GA circuitry. Random data for population memory 508 initially comes from a CA RNG embedded in the parent-crossover mutation bit slice. Crossover logic 518 combines the parent 1 and parent 2 values in a probabilistic manner. Mutation of the resulting combination between parent 1 and parent 2 occurs, if at all, in mutation logic 520 and then is stored in child register 522 for further processing.

Each new child chromosome in child register 522 is also provided with a fitness value. Fitness function logic 524 processes the child chromosome stored in child register 522 according to the predetermined evaluation criteria to create the initial fitness value. This fitness value for the child chromosome is stored along with the child chromosome in evaluated child and fitness register 526 awaiting further processing/evaluation. If the fitness function analyzes mass spectrographic data in parallel or has a similar parallel structure as previously described, implementations of the present invention can be used to reduce the memory or storage required. This can be advantageous in lowering costs and more rapidly bring mass spectroscopy analysis software/hardware products to market.

Once the child fitness value is evaluated, child and fitness register 526 is compared with the corresponding fitness of the lesser fit parent in population memory 503 using survival logic 528. To locate the lesser fit parent more readily, the address of the lesser fit parent can be stored in a lesser-fit register. If the child chromosome has a better fitness than the lesser fit parent, it replaces the lesser fit parent and is stored at the lesser fit parent's address in population memory 508. Over time, the random numbers stored in population memory 508 evolve into an optimal solution in accordance with the GA analysis process. For example, the optimal solution could identify a sequence of amino acids or polypeptides that make up an unknown protein being researched through mass spectroscopy techniques.

Figure 6:
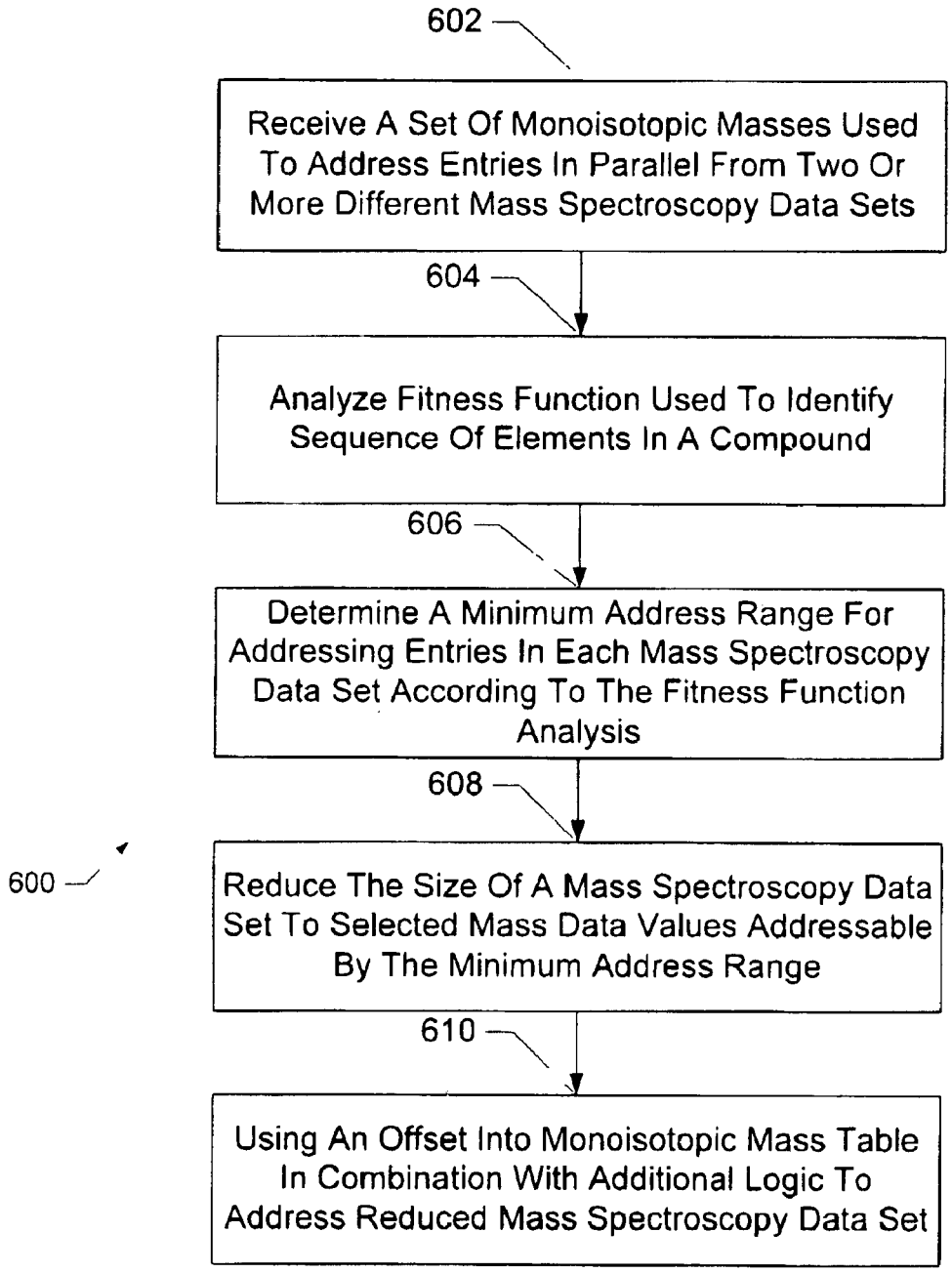
FIG. 6 is a flowchart diagram depicting the operations associated with implementations of the present invention to reduce the memory or storage used by a fitness function.

FIG. 6 is a flowchart diagram depicting the operations associated with implementations of the present invention to reduce the memory or storage used in a fitness function. In one implementation, these steps are performed when optimizing a fitness function that typically operates on various data sets in parallel. Alternate implementations that don't operate on data sets in parallel may also use the present, invention if the memory or storage reduction operations are helpful.

In one implementation, a set of monoisotopic masses are used to address entries in parallel from two or more different mass spectroscopy data sets (602). The monoisotopic masses are generally entered in a table and contain the 19 different mass weights associated with the 20 different amino acids used to build proteins. The monoisotopic mass tables are identical to each other but used differently in the fitness function as described previously.

Next, the fitness function is analyzed to identify a sequence of elements in a compound (604). Many times in biological or scientific analysis, it is known what elements make up a compound but not the quantity or sequence of the elements. This information is important in determining the address range and storage requirements for a given fitness function. In the case of protein compounds, it is known that the elements that make up proteins are amino acids. In particular, these 20 different amino acids have 19 different unique masses and are combined in differing sequences and quantities depending on the protein being analyzed.

Determine a minimum address range for addressing entries in each mass spectroscopy data set according to the fitness function analysis (606). The minimum address range depends on the number of elements used to make the compound and the logic used in the fitness function. For example, addressing a single amino acid element in a protein may be represented using a 5-bit address having 32 different addresses since only 19 different elements are possible. Similarly, two amino acid elements may be represented using as few as a 9-bit address having 512 different addresses since only $19^2$ or 361 different amino acids or combinations are possible using two amino acids.

Reduce the size of a mass spectroscopy data set to selected mass data values addressable by the minimum address range (608). Once the address range is reduced, the memory or storage holding the mass spectroscopy data can also be reduced. The memory or storage space is generally rounded to the nearest binary value to hold the storage requirements. For example, a memory or storage area of 1024 or 512 storage units can be allocated to store 361 different amino acids. The smaller memory size (i.e., 512 storage units) can be used if adding the logic cell area to calculate the smaller address range is not cost-prohibitive given the application.

The modified fitness function uses an offset into monoisotopic mass table in combination with additional logic to address reduced mass spectroscopy data set (610). In accordance with one implementation of the present invention, the reduced storage or memory is accessed using only the offset or address into the monoisotopic mass table rather than the actual mass value (which is generally much larger). The monoisotopic mass table offset or address can be used directly or in combination with other monoisotopic mass table offsets or addresses to generate the needed final address into the mass spectroscopy data set. For example, two or more monoisotopic mass table offsets or addresses can be concatenated together or combined together by way of multiplication with other constants. Many other logic designs can also be used to both address or access the mass spectroscopy data and accommodate the reduced memory or storage size.

Figure 7:
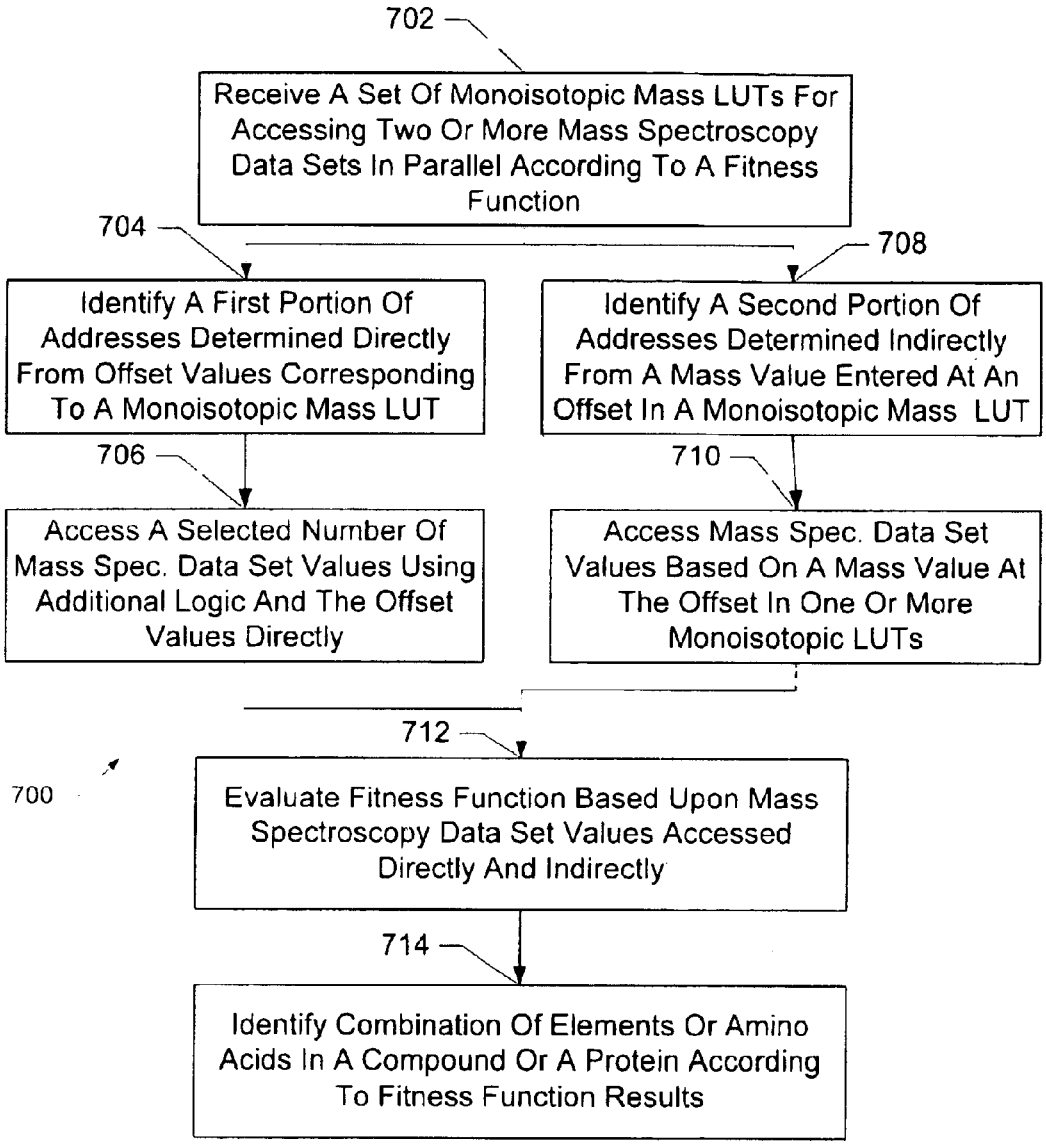
FIG. 7 is a flow chart diagram of the operations for using a fitness function having reduced memory or storage sizes in accordance with the present invention.

FIG. 7 is a flow chart diagram of the operations for using a fitness function having reduced memory or storage sizes in accordance with the present invention. These operations concern operating the fitness function during analysis once the memory or storage sizes have been reduced in accordance with the present invention. As before, a fitness function has a set of monoisotopic mass LUTs for accessing two or more mass spectroscopy data sets in parallel (702). Using implementations of the present invention, the two or more mass spectroscopy data sets may be accessed differently depending on the size of the mass spectroscopy data sets. In one implementation, the fitness function identifies a first portion of addresses in the mass spectroscopy data set to be determined directly from offset values corresponding to a monoisotopic mass LUT (704). Typically, these mass spectroscopy data sets are contained in a smaller address range and do not need a wide address or mass value for access. For example, a mass spectroscopy data set having only 19 entries needs only a 5-bit address read directly from one 5-bit register in an electronic chromosome. The resulting address is used by the fitness function to access a selected number of mass spec data set values using additional logic and the offset values directly (706). In some cases, access may require combining one or more offsets or addresses corresponding to the monoisotopic mass LUT together through concatenation or other logical operations involving selected constants and arithmetic operations as previously described.

Alternatively, the fitness function identifies a second portion of addresses determined indirectly from a mass value entered at an offset in a monoisotopic mass LUT (708). The second portion of addresses generally corresponds to larger range of addresses that also need a larger storage area. These addresses can be determined by identifying the mass at an offset into the monoisotopic mass table and then using this mass (with some processing) to identify the corresponding mass in the mass spectroscopy data set. For example, the sum of six different monoisotopic masses may be used to address an entry in a mass spectroscopy table. Thus, accessing the mass spectroscopy data set values depends on the combined mass values at the offset in one or more monoisotopic mass LUTs.

Values from the first portion and second portion of addresses are evaluated using the fitness function according to mass spectroscopy data set values (712) and eventually the combination of elements or compound is identified (714). For example, the amino acid sequence of elements is determined in the case of protein compounds.

While examples and implementations have been described, they should not serve to limit any aspect of the present invention. Accordingly, implementations of the invention can be implemented in digital electronic circuitry, or in computer hardware, firmware, software, or in combinations of them. Apparatus of the invention can be implemented in a computer program product tangibly embodied in a machine-readable storage device for execution by a programmable processor; and method steps of the invention can be performed by a programmable processor executing a program of instructions to perform functions of the invention by operating on input data and generating output. The invention can be implemented advantageously in one or more computer programs that are executable on a programmable system including at least one programmable processor coupled to receive data and instructions from, and to transmit data and instructions to, a data storage system, at least one input device, and at least one output device. Each computer program can be implemented in a high-level procedural or object-oriented programming language, or in assembly or machine language if desired; and in any case, the language can be a compiled or interpreted language. Suitable processors include, by way of example, both general and special purpose microprocessors. Generally, a processor will receive instructions and data from a read-only memory and/or a random access memory. Generally, a computer will include one or more mass storage devices for storing data files; such devices include magnetic disks, such as internal hard disks and removable disks; magneto-optical disks; and optical disks. Storage devices suitable for tangibly embodying computer program instructions and data include all forms of non-volatile memory, including by way of example semiconductor memory devices, such as EPROM, EEPROM, and flash memory devices; magnetic disks such as internal hard disks and removable disks; magneto-optical disks; and CD-ROM disks. Any of the foregoing can be supplemented by, or incorporated in, ASICs.

While specific embodiments have been described herein for purposes of illustration, various modifications may be made without departing from the spirit and scope of the invention. Accordingly, the invention is not limited to the above-described implementations, but instead is defined by the appended claims in light of their full scope of equivalents.

What is claimed is:

1. A method of reducing storage requirements for identifying a sequence of elements in a compound, comprising:

receiving a set of monoisotopic masses designed to address entries from two or more mass spectroscopy data sets according to a fitness function;

analyzing the fitness function configured to facilitate identification of a sequence of elements in the compound;

determining a minimum address range for addressing entries in each of the two or more mass spectroscopy data sets according to sequence of elements and fitness function analysis; and reducing the size of at least one of the two or more mass spectroscopy data sets to selected mass data values according to the minimum address range.

2. The method of claim 1 further comprising, using an offset from one or more monoisotopic mass tables in combination with additional logic to address the selected mass data values in the at least one of the two or more reduced mass spectroscopy data sets.

3. The method of claim 2 wherein the additional logic includes a concatenation of the offset values from the one or more monoisotopic mass tables to address the selected mass data values.

4. The method of claim 1 wherein the monoisotopic masses are designed to address entries from two or more mass spectroscopy data sets in parallel.

5. The method of claim 1 wherein the sequence of elements in the compound corresponds to a sequence of amino acids in a protein.

6. The method of claim 1 wherein the analysis of the fitness function includes identifying entries in at least one of the two or more mass spectroscopy data sets that inherently cannot be addressed due to characteristics of the fitness function.

7. The method of claim 6 wherein the characteristics of the fitness function allows for addressing only a smaller subset of the addresses in one of the two or more mass spectroscopy data sets.

8. The method of claim 1 wherein the selected mass data values are associated with addresses within the minimum address range.

9. A method of identifying a sequence of elements in a compound with reduced storage requirements, comprising:

receiving a set of monoisotopic mass lookup tables for accessing two or more mass spectroscopy data sets in parallel according to a fitness function;

identifying a first portion of addresses determined directly from offset values corresponding to a monoisotopic mass lookup table from the set of monoisotopic mass lookup tables;

accessing a selected number of mass spectroscopy data set values for the compound using additional logic and the offset values directly; and evaluating the fitness function to determine elements in the compound based upon mass spectroscopy data set values accessed directly from the offset values corresponding to the monoisotopic mass lookup table.

10. The method of claim 9 further comprising:

identifying a combination of elements in a compound according to the fitness function evaluation.

11. The method of claim 9 wherein the compound is a protein and the elements correspond to one or more amino acids.

12. The method of claim 9 further comprising:

identifying a second portion of addresses determined indirectly from a mass value entered at an offset in a monoisotopic lookup table; and accessing mass spectroscopy data set values based on a mass value at the offset in the one or more monoisotopic lookup tables.

13. The method of claim 12 wherein evaluating the fitness function is further based upon mass spectroscopy data set values accessed indirectly from the mass value at the offset in the one or more monoisotopic lookup table.

14. A computer program product for reducing storage requirements when identifying a sequence of elements in a compound, tangibly stored on a computer-readable medium, comprising instructions operable to cause a programmable processor to:

receive a set of monoisotopic masses designed to address entries from two or more mass spectroscopy data sets according to a fitness function;

analyze the fitness function configured to facilitate identification of a sequence of elements in the compound;

determine a minimum address range for addressing entries in each of the two or more mass spectroscopy data sets according to sequence of elements and fitness function analysis; and reduce the size of at least one of the two or more mass spectroscopy data sets to selected mass data values according to the minimum address range.

15. The computer program product of claim 14 further comprising instructions operable to cause a programmable processor to, use an offset from one or more monoisotopic mass tables in combination with additional logic to address the selected mass data values in the at least one of the two or more reduced mass spectroscopy data sets.

16. The computer program product of claim 15 wherein the additional logic includes a concatenation of the offset values from the one or more monoisotopic mass tables to address the selected mass data values.

17. The computer program product of claim 14 wherein the monoisotopic masses are designed to address entries from two or more mass spectroscopy data sets in parallel.

18. The computer program product of claim 14 wherein the sequence of elements in the compound corresponds to a sequence of amino acids in a protein.

19. The computer program product of claim 14 wherein the analysis of the fitness function includes identifying entries in at least one of the two or more mass spectroscopy data sets that inherently cannot be addressed due to characteristics of the fitness function.

20. The computer program product of claim 19 wherein the characteristics of the fitness function allows for addressing only a smaller subset of the addresses in one of the two or more mass spectroscopy data sets.

21. The computer program product of claim 14 wherein the selected mass spectroscopy data set values are associated with addresses within the minimum address range.

22. A computer program product for identifying a sequence of elements in a compound with reduced storage requirements, tangibly stored on a computer-readable medium, comprising instructions operable to cause a programmable processor to:

receive a set of monoisotopic mass lookup tables for accessing two or more mass spectroscopy data sets in parallel according to a fitness function;

identify a first portion of addresses determined directly from offset values corresponding to a monoisotopic mass lookup table from the set of monoisotopic mass lookup tables;

access a selected number of mass spectroscopy data set values for the compound using additional logic and the offset values directly; and evaluate the fitness function to determine elements in the compound based upon mass spectroscopy data set values accessed directly from the offset values corresponding to the monoisotopic mass lookup table.

23. The computer program product of claim 22 further comprising instructions operable to cause a programmable processor to:

identify a combination of elements in a compound according to the fitness function evaluation.

24. The computer program product of claim 22 wherein the compound is a protein and the elements correspond to one or more amino acids.

25. The computer program product of claim 22 further comprising instructions operable to cause a programmable processor to:

identify a second portion of addresses determined indirectly from a mass value entered at an offset in a monoisotopic lookup table; and access mass spectroscopy data set values based on a mass value at the offset in the one or more monoisotopic lookup tables.

26. The computer program product of claim 22 wherein evaluating the fitness function is further based upon mass spectroscopy data set values accessed indirectly from the mass value at the offset in the one or more monoisotopic mass lookup tables.

27. An apparatus for reducing storage requirements for identifying a sequence of elements in a compound, comprising:

means for receiving a set of monoisotopic masses designed to address entries from two or more mass spectroscopy data sets according to a fitness function;

means for analyzing the fitness function configured to facilitate identification of a sequence of elements in the compound;

means for determining a minimum address range for addressing entries in each of the two or more mass spectroscopy data sets according to sequence of elements and fitness function analysis; and means for reducing the size of at least one of the two or more mass spectroscopy data sets to selected mass data values according to the minimum address range.

28. The apparatus of claim 27 further comprising, means for using an offset from one or more monoisotopic mass tables in combination with additional logic to address the selected mass data values in the at least one of the two or more reduced mass spectroscopy data sets.

29. An apparatus for identifying a sequence of elements in a compound with reduced storage requirements, comprising:

means for receiving a set of monoisotopic mass lookup tables for accessing two or more mass spectroscopy data sets in parallel according to a fitness function;

means for identifying a first portion of addresses determined directly from offset values corresponding to a monoisotopic mass lookup table from the set of monoisotopic mass lookup tables;

means for accessing a selected number of mass spectroscopy data set values for the compound using additional logic and the offset values directly; and means for evaluating the fitness function to determine elements in the compound based upon mass spectroscopy data set values accessed directly from the offset values corresponding to the monoisotopic mass lookup table.

30. The apparatus of claim 29 further comprising:

means for identifying a combination of elements in a compound according to the fitness function evaluation.

31. An apparatus for reducing storage requirements identifying a sequence of elements in a compound, comprising:

a processor;

a memory containing instructions when executed on the processor cause the processor to receive a set of monoisotopic mass tables designed to address entries from two or more mass spectroscopy data sets according to a fitness function, analyzing the fitness function configured to facilitate identification of a sequence of elements in the compound, determining a minimum address range for addressing entries in each of the two or more mass spectroscopy data sets according to sequence of elements and fitness function analysis and reducing the size of at least one of the two or more mass spectroscopy data sets to selected mass data values according to the minimum address range.

32. An apparatus for identifying a sequence of elements in a compound with reduced storage requirements, comprising:

a processor;

a memory containing instructions when executed on the processor cause the processor to receive a set of monoisotopic mass lookup tables for accessing two or more mass spectroscopy data sets in parallel according to a fitness function, identify a first portion of addresses determined directly from offset values corresponding to a monoisotopic mass lookup table from the set of monoisotopic mass lookup tables, access a selected number of mass spectroscopy data set values for the compound using additional logic and the offset values directly and evaluate the fitness function to determine elements in the compound based upon mass spectroscopy data set values accessed directly from the offset values corresponding to the monoisotopic mass lookup table.

* * * * *